US009157694B1

(12) United States Patent
Tseng

(10) Patent No.: US 9,157,694 B1
(45) **Date of Patent: *Oct. 13, 2015**

(54) PRESSURIZED AIR POWERED FIRING DEVICE

(71) Applicant: STARJET Technologies Co., LTD, Jintan (CN)

(72) Inventor: Jui-Fu Tseng, Yilan (TW)

(73) Assignee: STARJET Technologies Co., LTD, Jintan, Jiangsu (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/064,139

(22) Filed: Oct. 26, 2013

(51) Int. Cl.
*F41B 11/06* (2006.01)
*F41B 11/62* (2013.01)

(52) U.S. Cl.
CPC ..... *F41B 11/62* (2013.01)

(58) Field of Classification Search
CPC ..... F42B 12/68
USPC ..... 124/57–95; 42/1.09, 1.16
See application file for complete search history.

(56) References Cited

U.S. PATENT DOCUMENTS

| | | | | |
|---|---|---|---|---|
| 2,955,586 | A * | 10/1960 | Hamrick | 124/57 |
| 4,155,342 | A * | 5/1979 | Traweek | 124/16 |
| 2006/0054152 | A1* | 3/2006 | Ambrico | 124/71 |
| 2011/0041826 | A1* | 2/2011 | Liao | 124/71 |

* cited by examiner

*Primary Examiner* — Reginald Tillman, Jr.

(57) ABSTRACT

A firing device is provided with a housing, a sleeve in the housing, an air canister in the sleeve, a mechanism, and a pushing assembly. Pushing of the sliding cap forward exposes the push button and moves the spring depressible detent to the first depression, a pressing of the push button pushes down the sliding member, the pressing does not push down the sliding member further after the sliding member clearing the second though hole, the sharp member is pushed rearward by the spring biased cylindrical member to open the air canister by piercing, pressurized air released from the air canister pushes the mechanism including the sliding member back to a position prior to the pressing, the pressurized air travels forward to be stopped by the diaphragm with air pressure being further increased, and the diaphragm will be broken after the air pressure increase exceeds a predetermined pressure.

1 Claim, 5 Drawing Sheets

PRESSURIZED AIR POWERED FIRING DEVICE

BACKGROUND OF THE INVENTION

1. Field of the Invention

The invention relates to firing devices and more particularly to a pressurized air powered firing device.

2. Description of Related Art

A conventional lasso projection device or gun comprising a barrel having a discharge end and an operator end, sliding means slidably communicating with the barrel along a longitudinal axis of the barrel, front holding means for reversibly holding a lasso mounted on the sliding means, activating means for forcibly sliding the sliding means along the longitudinal axis of the barrel from a first position distal to the discharge end of the barrel to a second position proximal to the discharge end of the barrel, an arm having a pivot on one end and a rear lasso holding means for reversibly holding a lasso adjacent to the other end, the arm pivotally mounted about the pivot on the barrel such that the rear lasso holding means moves in an arc with one end of the arc being towards the operator end of the barrel and the other end of the arc being toward the discharge end of the barrel, lasso means for lassoing a target, the lasso means including a lasso having a loop encircling the front and the rear lasso holding means when the sliding means is in the first position and the rear lasso holding means is at the end of the arc toward an operator end of the barrel, such that when the sliding means slides from the first position towards the discharge end of the barrel, the motion of the sliding means is transferred to the lasso by the front lasso holding means via the loop of the lasso and the loop also pulls the rear lasso holding means through the arc and as the rear lasso holding means approaches the end of the arc toward the discharge end of the barrel and the sliding means approaches and stops in the second position, and the lasso is discharged from the discharge end of the barrel towards a target.

Notwithstanding the conventional device for projecting lasso, the invention is neither taught nor rendered obvious thereby.

SUMMARY OF THE INVENTION

It is therefore one object of the invention to provide a firing device comprising a cylindrical housing comprising a rear case, a forward hollow member, an elongated slot formed on a circumferential surface and including a first through hole, a stop member releasably fastened on the slot rearward of the first through hole, first and second depressions formed on the slot forwardly of the first through hole, a raised sliding cap slidably disposed on the slot to contact the stop member with both the through hole and the second depression being concealed, and a spring depressible detent disposed in the sliding cap and positioned in the second depression; a sleeve disposed in the housing and comprising a forward diaphragm and a second through hole formed on a circumferential surface and being aligned with the first through hole; an air canister disposed in the sleeve; a mechanism comprising a spring biased cylindrical member anchored in the sleeve, a receptacle formed in the cylindrical member, a spring biased sliding member disposed in and projecting out of the receptacle into the second through hole, and a sharp member disposed at a rear end of the cylindrical member, the sharp member facing and spaced from a front end of the air canister; and a pushing assembly comprising a lower support including an internally threaded cup disposed through the first through hole, a projection extending downward from an underside of the internally threaded cup to urge against the sliding member, and an annular first flange formed on a joining portion of the internally threaded cup and the first projection; a top push button concealed by the sliding cap and including an annular second flange and an externally threaded shank projecting downward to secure to the internally threaded cup; and a spring member anchored between the first flange and the second flange; wherein a pushing of the sliding cap forward exposes the push button and moves the spring depressible detent to the first depression to be positioned, a pressing of the push button pushes down both the projection and the sliding member with the spring member being compressed, the pressing does not push down the sliding member further after the sliding member clearing the second though hole, the sharp member is pushed rearward by the spring biased cylindrical member to open the air canister by piercing, pressurized air released from the air canister pushes the mechanism including the spring biased sliding member back to a position prior to the pressing, the pressurized air travels forward to be stopped by the diaphragm with air pressure being further increased, the diaphragm will be broken after the air pressure increase exceeds a predetermined pressure, and the pressurized air further travels forward to pass through the forward hollow member.

The above and other objects, features and advantages of the invention will become apparent from the following detailed description taken with the accompanying drawings.

DETAILED DESCRIPTION OF THE INVENTION

Figure 1:
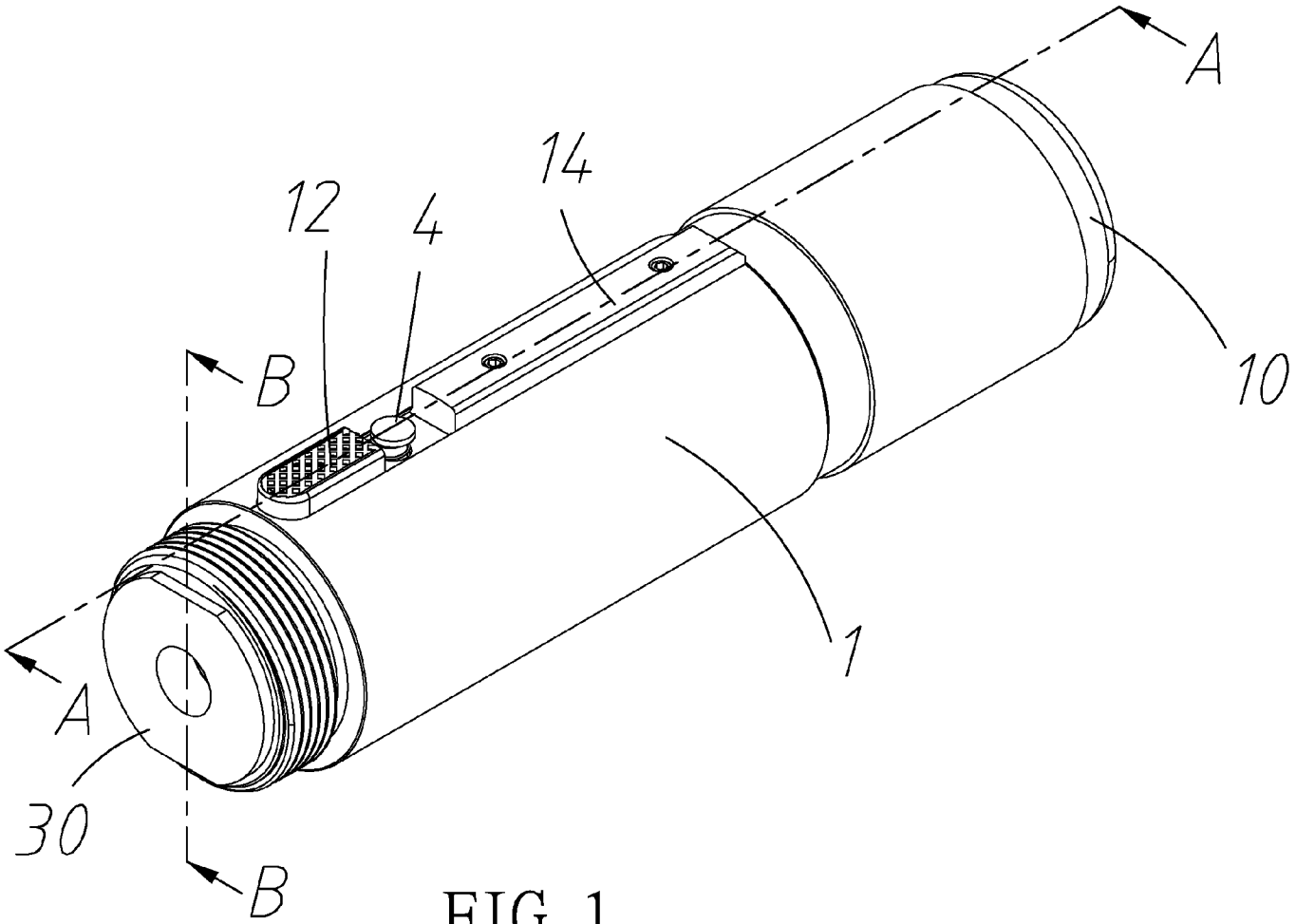
FIG. 1 is a perspective view of a pressurized air powered firing device according to the invention.
Figure 2:
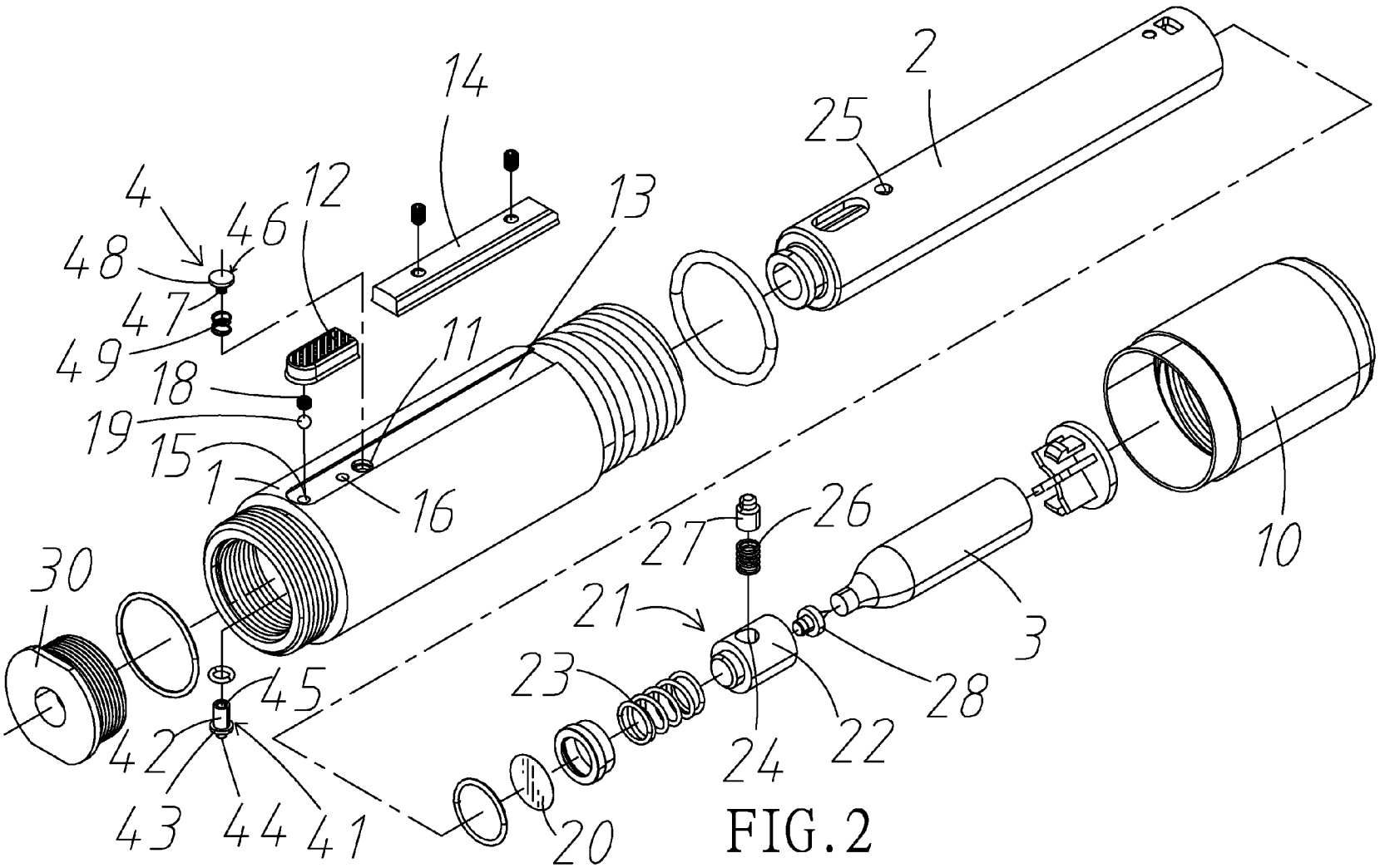
FIG. 2 is an exploded view of the firing device.
Figure 3:
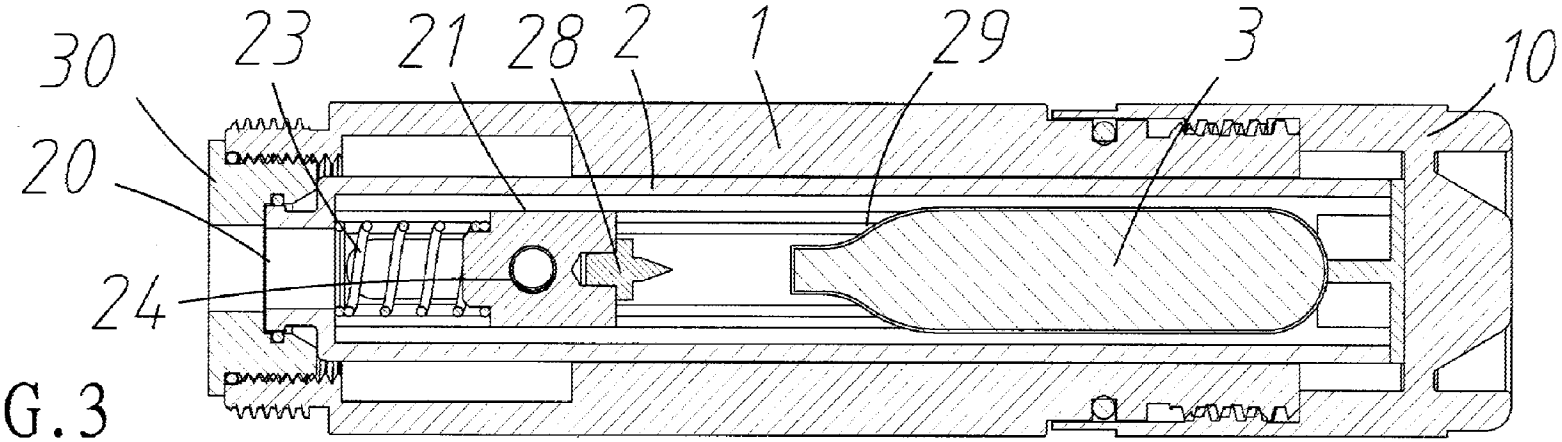
FIG. 3 is a sectional view taken along line A-A of FIG. 1.
Figure 4:
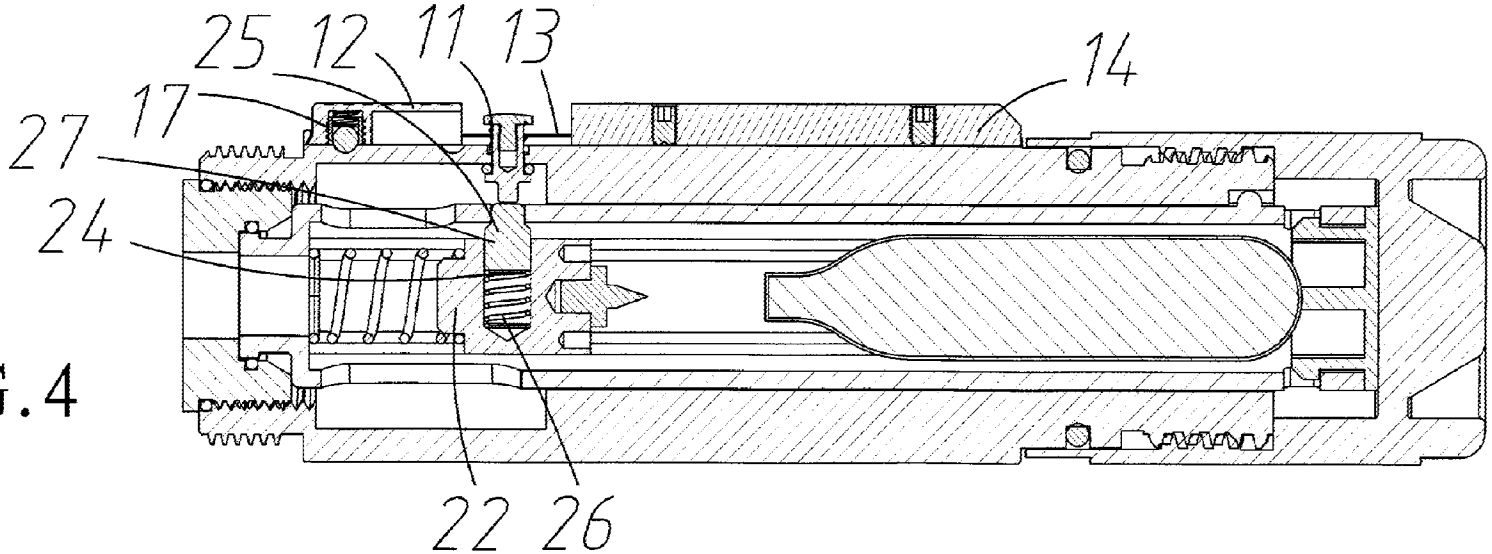
FIG. 4 is a sectional view taken along line B-B of FIG. 1.

Referring to FIGS. 1 to 7, a pressurized air powered firing device in accordance with the invention comprises the following components as discussed in detail below.

A cylindrical housing 1 has an externally threaded forward extension adapted to secure to a head assembly (not shown) containing a projectile (not shown) and an externally threaded rearward extension adapted to secure to a rear case 10. Internal threads are formed on an inner surface of the forward extension and are adapted to secure to an externally threaded, hollow member 30.

A cylindrical sleeve 2 is disposed in the housing 1 and has two ends open. The sleeve includes a through hole 25 on a circumferential surface. A mechanism 21 includes a cylindrical member 22, a torsion spring 23 having a rear portion put on a front neck of the cylindrical member 22 and a front end urging against a shoulder on an inner surface of the sleeve 2 to be anchored, a receptacle 24 formed on the cylindrical member 22, a spring 26 disposed in the receptacle 24, a sliding member 27 disposed on a top end of the spring 26 and projecting out of the receptacle 24 into the through hole 25, and a sharp member 28 disposed at a center of a rear end of the cylindrical member 22. A cylindrical air canister 3 is disposed in the sleeve 4 from an intermediate portion through a rear portion of the sleeve 4 to urge against a seat (not numbered) which is disposed at a blind end of the case 10. Further, a shoulder 29 on an inner surface of the sleeve 2 urges against a front transition portion of the air canister 3 for anchoring the air canister 3. The sharp member 28 faces and is spaced from a front end of the air canister 3 in an inoperative position. The mechanism 21 further comprises a diaphragm 20 mounted on the front opening of the sleeve 2.

On a front top portion of the housing 1, there is provided an elongated slot 13 having a through hole 11, a rectangular stop member 14 threadedly fastened on intermediate and rear portions of the slot 13, first and second depressions 15, 16 formed on a front portion of the slot 13 in front of the through hole 11, a raised sliding cap 12 slidably disposed on a front portion of the slot 13, a receptacle 17 formed on a front bottom portion of the sliding cap 12, a spring 18 anchored in the receptacle 17, and a steel ball 19 urged by a bottom end of the spring 18 and disposed in the second depression 16 when the through hole 11 is covered by the sliding cap 12. The through hole 11 is aligned with the sliding member 27 thereunder. A rear end of the sliding cap 12 contacts a front end of the stop member 14 in an inoperative position.

A pushing assembly 4 comprises a lower support 41 including a cup 42 having an internally threaded upper portion 45, a projection 44 extending downward from an underside of the cup 42, and an annular flange 43 on a joining portion of the cup 42 and the projection 44; a push button 46 including an annular flange 48 and an externally threaded shank 47 projecting downward to secure to the internally threaded upper portion 45; and a torsion spring 49 anchored between the flanges 43 and 48. The cup 42 disposes through the through hole 11. The bottom end of the projection 44 urges against a top end of the sliding member 27. The push button 46 is concealed by the sliding cap 12 in the inoperative position.

Figure 5:
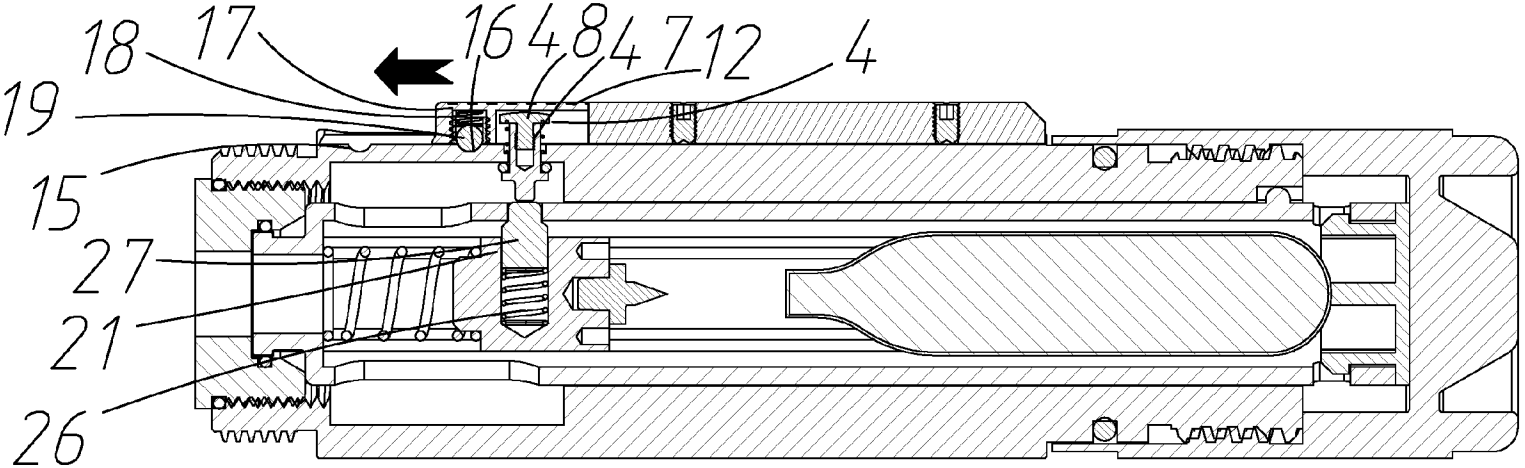
FIG. 5 is a view similar to FIG. 4 showing the push button being concealed by the sliding cap after sliding the sliding cap toward the push button.
Figure 6:
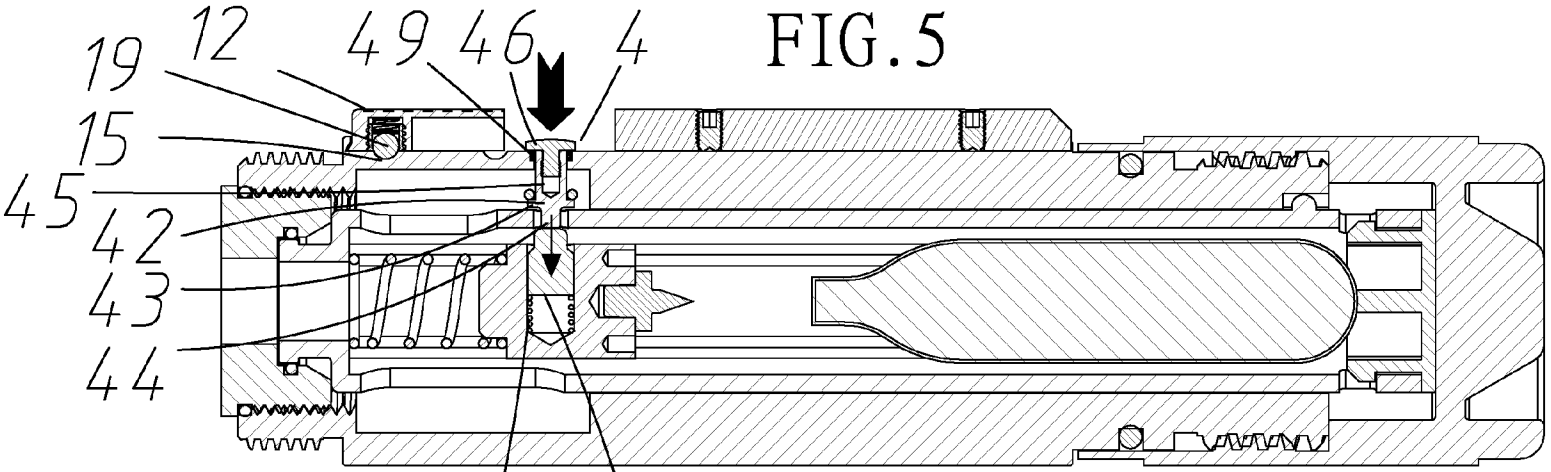
FIG. 6 is a view similar to FIG. 5 as a next step of pushing down the sliding member by pressing the push button.
Figure 7:
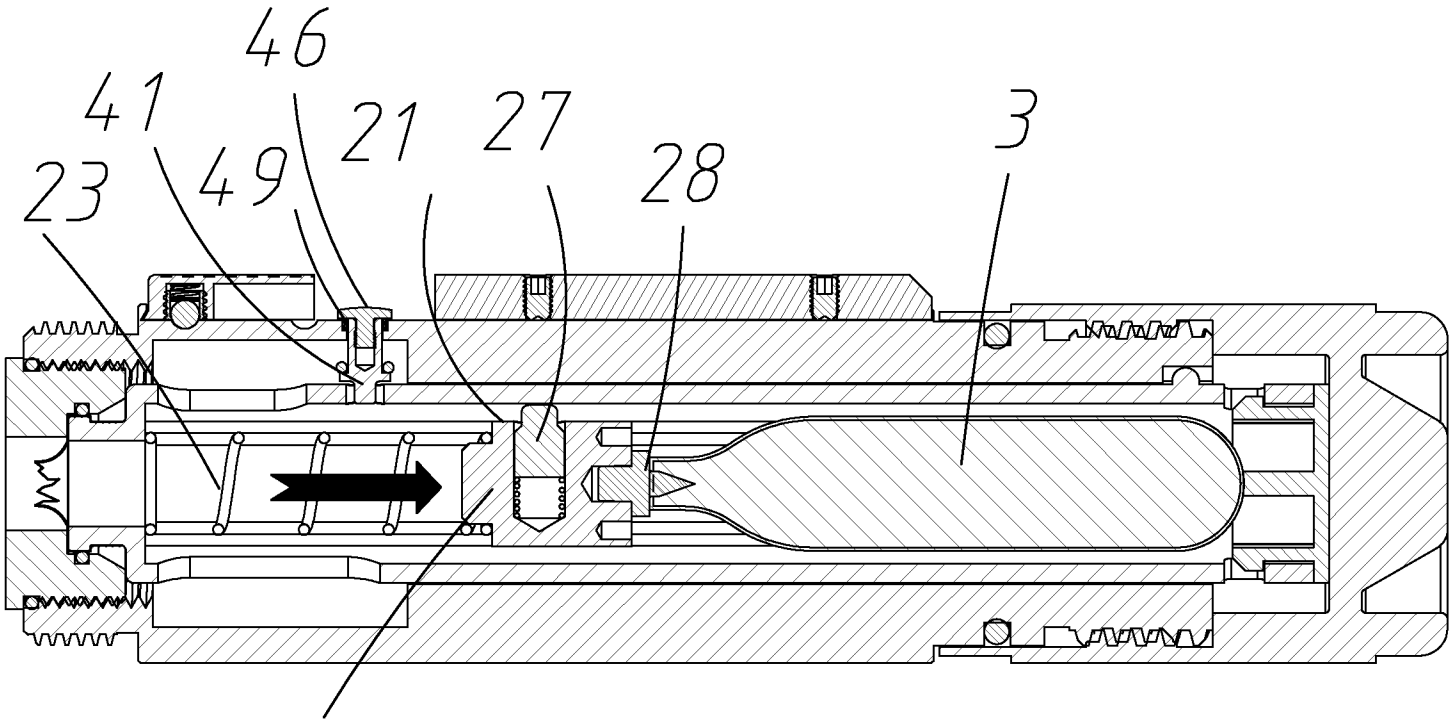
FIG. 7 is a view similar to FIG. 6 as a next step of piercing the air canister prior to firing.

Is use (see FIGS. 5, 6 and 7), an operator may first push the sliding cap 12 forward to expose the push button 46 and move the steel ball 19 from the second depression 16 to the first depression 15 to be positioned (see arrows in FIGS. 5 and 6). Next, the operator may press the push button 46 to push down both the projection 44 and the sliding member 27 with both the springs 49, 26 being compressed (see arrows in FIG. 6). The pushing will not push down the sliding member 27 further after the top of the sliding member 27 clearing the though hole 25 (i.e., reaching the point of no return). And in turn, the compressed spring 23 releases its elastic force to quickly push the cylindrical member 22 rearward. And in turn, the concealed opening of the air canister 3 is pierced to open by the sharp member 28. The pressurized air in the air canister 3 thus pushes the mechanism 21 back to its original, inoperative position with the spring 23 being compressed and the sliding member 27 being pushed into the through hole 25. Also, the pressurized air travels forward to be stopped by the diaphragm 20 with air pressure being further increased. The diaphragm 20 will be broken after the air pressure increase exceeds a predetermined pressure. It is noted that the predetermined pressure depends upon thickness and material of the diaphragm 20. The pressurized air further travels forward to pass the externally threaded, hollow member 30 to project a predetermined projectile out of the head assembly.

While the invention has been described in terms of preferred embodiments, those skilled in the art will recognize that the invention can be practiced with modifications within the spirit and scope of the appended claims.

What is claimed is:

1. A firing device comprising:

a cylindrical housing comprising a rear case, a forward hollow member, an elongated slot formed on a circumferential surface and including a first through hole, a stop member releasably fastened on the slot rearward of the first through hole, first and second depressions formed on the slot forwardly of the first through hole, a raised sliding cap slidably disposed on the slot to contact the stop member with both the through hole and the second depression being concealed, and a spring depressible detent disposed in the sliding cap and positioned in the second depression;

a sleeve disposed in the housing and comprising a forward diaphragm and a second through hole formed on a circumferential surface and being aligned with the first through hole;

an air canister disposed in the sleeve;

a mechanism comprising a spring biased cylindrical member anchored in the sleeve, a receptacle formed in the cylindrical member, a spring biased sliding member disposed in and projecting out of the receptacle into the second through hole, and a sharp member disposed at a rear end of the cylindrical member, the sharp member facing and spaced from a front end of the air canister; and a pushing assembly comprising a lower support including an internally threaded cup disposed through the first through hole, a projection extending downward from an underside of the internally threaded cup to urge against the sliding member, and an annular first flange formed on a joining portion of the internally threaded cup and the first projection; a top push button concealed by the sliding cap and including an annular second flange and an externally threaded shank projecting downward to secure to the internally threaded cup; and a spring member anchored between the first flange and the second flange;

wherein a pushing of the sliding cap forward exposes the push button and moves the spring depressible detent to the first depression to be positioned, a pressing of the push button pushes down both the projection and the sliding member with the spring member being compressed, the pressing does not push down the sliding member further after the sliding member clearing the second though hole, the sharp member is pushed rearward by the spring biased cylindrical member to open the air canister by piercing, pressurized air released from the air canister pushes the mechanism including the spring biased sliding member back to a position prior to the pressing, the pressurized air travels forward to be stopped by the diaphragm with air pressure being further increased, the diaphragm will be broken after the air pressure increase exceeds a predetermined pressure, and the pressurized air further travels forward to pass through the forward hollow member.

* * * * *